US008440133B2

(12) United States Patent
Eto et al.

(10) Patent No.: US 8,440,133 B2
(45) **Date of Patent: *May 14, 2013**

(54) COOLING APPARATUS, COOLING METHOD, MANUFACTURING APPARATUS AND MANUFACTURING METHOD OF HOT-ROLLED STEEL SHEET

(75) Inventors: Manabu Eto, Kashima (JP); Yoichi Haraguchi, Sakura (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/305,845

(22) Filed: Nov. 29, 2011

(65) Prior Publication Data

US 2012/0068391 A1 Mar. 22, 2012

Related U.S. Application Data

(63) Continuation of application No. PCT/JP2010/060970, filed on Jun. 28, 2010.

(30) Foreign Application Priority Data

Jun. 30, 2009 (JP) ..... 2009-156247

(51) Int. Cl.
*C21D 1/62* (2006.01)

(52) U.S. Cl.
USPC ..... 266/113; 266/46; 266/114

(58) Field of Classification Search ..... 266/46, 266/113, 114
See application file for complete search history.

(56) References Cited

U.S. PATENT DOCUMENTS

| | | | | |
|---|---|---|---|---|
| 7,523,631 | B2 * | 4/2009 | Fujibayashi et al. | 72/201 |
| 2012/0079863 | A1 * | 4/2012 | Hosho et al. | 72/201 |
| 2012/0104666 | A1 * | 5/2012 | Kobayashi et al. | 266/44 |

FOREIGN PATENT DOCUMENTS

| | | |
|---|---|---|
| JP | 2005-213595 | 8/2005 |
| JP | 2007-061838 | 3/2007 |
| JP | 4029865 | 10/2007 |

* cited by examiner

*Primary Examiner* — Scott Kastler
(74) *Attorney, Agent, or Firm* — Clark & Brody

(57) ABSTRACT

The present invention provides a cooling apparatus of a hot-rolled steel sheet capable of manufacturing a hot-rolled steel sheet having ultra fine crystal grains. In the cooling apparatus, when defining as L1, a length in a transporting direction of a steel sheet, of a zone from a rolling reduction point in a final stand to an exit side of a housing post; defining as L2, a length in the transporting direction of the steel sheet, of an area where high-pressure water is continuously sprayed over the steel sheet, within the zone; and defining a ratio of L2/L1 as X, an average value Ps [kPa], in the transporting direction of the steel sheet, of an impact pressure of the high-pressure water on a surface of the steel sheet in the area of the length L2 satisfies $Ps \geqq 2.5X^{(-1/0.6)}$ on the above upper surface and lower surface of the steel sheet.

12 Claims, 10 Drawing Sheets

COOLING APPARATUS, COOLING METHOD, MANUFACTURING APPARATUS AND MANUFACTURING METHOD OF HOT-ROLLED STEEL SHEET

TECHNICAL FIELD

The present invention relates to a cooling apparatus, a cooling method, a manufacturing apparatus, and a manufacturing method of a hot-rolled steel sheet. More particularly, it relates to a cooling apparatus, a cooling method, and a manufacturing apparatus of a hot-rolled steel sheet, which are suited for use in manufacturing a hot-rolled steel sheet having ultra fine crystal grains; and a manufacturing method of a hot-rolled steel sheet having ultra fine crystal grains.

BACKGROUND ART

A steel material used for automobiles, structural materials, and the like is required to be excellent in such mechanical properties as strength, workability, and toughness. In order to improve these properties comprehensively, it is effective to make a hot-rolled steel sheet with fine crystal grains; to this end, a number of manufacturing methods to obtain a hot-rolled steel sheet which has fine crystal grains have been sought. Further, by refining crystal grains of a hot-rolled steel sheet, it is possible to manufacture a high strength hot-rolled steel sheet having excellent mechanical properties even if the amount of alloying elements added is reduced.

As a method for refining crystal grains of a hot-rolled steel material, for example, it is known to carry out a high rolling reduction, especially in the subsequent stage of hot finish rolling, refining austenite grains and causing accumulation of rolling strains within the grains; and thereby to refine the ferrite grains obtained after cooling (or after transformation). Further, in view of facilitating the ferrite transformation by inhibiting recrystallization and recovery of the austenite grains, it is effective to cool a steel sheet to below a predetermined temperature (e.g. 720° C. or below) within a short period of time after rolling. That is, in order to manufacture a hot-rolled steel sheet with fine crystal grains, it is effective, subsequent to hot finish rolling, to rapidly cool a steel sheet after rolling, by arranging a cooling apparatus capable of cooling more quickly after rolling than ever before.

Several techniques which enable manufacturing of a hot-rolled steel sheet having fine crystal grains, or several techniques which are applicable to manufacturing a hot-rolled steel sheet having fine crystal grains have been disclosed. For example, Patent Document 1 discloses a manufacturing method of a hot-rolled steel sheet having ultra fine crystal grains, wherein a hot-rolled steel sheet is manufactured by performing multi-pass hot rolling of a steel sheet or a slab consisting of a carbon steel or low-alloy steel containing 0.01% to 0.3% C by mass; a final rolling pass is completed at a temperature above $Ar_3$ point; and then cooling is performed to 720° C. or below, within 0.4 second. Patent Document 2 discloses manufacturing equipment of a hot-rolled steel sheet comprising: a final stand of a row of hot finish rolling mills; a first cooling apparatus; a second cooling apparatus; and a coiling apparatus, which are disposed in the mentioned order in a transporting direction of a steel sheet, wherein a non-cooling region is provided between the first cooling apparatus and the second cooling apparatus; the first cooling apparatus comprises: a nozzle which forms an impact region of a belt-like or ellipse-shaped jet on a surface to be cooled of the steel sheet; and a damming roll, which dams up the cooling water sprayed from the nozzle; and the damming roll is arranged in a manner that a pool of cooling water is formed in a region between a roll in the final stand and the damming roll, and that the steel sheet being transported in the first cooling apparatus is immersed into the pool of cooling water. Further, Patent Document 3 discloses hot-rolling equipment of a steel sheet, wherein cooling equipment for supplying cooling water onto an upper surface of a steel sheet while passing the steel sheet, is disposed at a position close to an entry side and/or an exit side of a rolling mill which hot-rolls the steel sheet; the cooling equipment comprises a header which has a nozzle configured to spray rod-like water over the upper surface of the steel sheet at an angle of depression in the range of 30° to 60° toward the rolling mill; and the header is positioned such that the cooling water supplied to the steel sheet is retained by the work rolls in the rolling mill. Patent Document 3 also discloses that a distance between a tip of an upper nozzle and a pass line is preferably set in the range of 500 mm to 1800 mm in order to avoid a situation that the cooling water becomes diffused and loses its rod-like shape; and that the effects of retaining the cooling water is deteriorated.

CITATION LIST

Patent Literature

Patent Document 1: Japanese Patent Application Laid-Open (JP-A) No. 2005-213595
Patent Document 2: Japanese Patent No. 4029865
Patent Document 3: JP-A No. 2007-061838

SUMMARY OF INVENTION

Problems to be Solved by the Invention

According to the technique disclosed in Document 1, it is seen that a hot-rolled steel sheet having ultra fine crystal grains (e.g. crystal grains having an average grain diameter of 2 μm or less; the same shall apply hereinafter) can be manufactured, since the steel sheet having a temperature of $Ar_3$ point or more is cooled to 720° C. within 0.4 second after the completion of the final rolling pass. However, a detailed configuration of the cooling apparatus capable of cooling a steel sheet to 720° C. within 0.4 second after the completion of the final rolling pass is not disclosed. Further, according to the technique disclosed in Patent Document 2, it is seen that a cooling efficiency of a hot-rolled steel sheet can be improved since the steel sheet is immersed into the pool of cooling water formed in the region between the roll in the final stand of the row of hot-rolling mills and the damming roll. Here, rapid cooling necessitated in manufacturing a hot-rolled steel sheet having ultra fine crystal grains should have a cooling rate of at least 400° C./s or more, for example, as described in Patent Document 1; and this requires the steel sheet to be rapidly cooled by way of nuclear boiling cooling. However, as disclosed in Patent Document 2, if a steel sheet is cooled by actively forming a pool of cooling water, it is difficult to increase an impact pressure of the cooling water striking against a surface of the steel sheet to a degree that enables nuclear boiling cooling; thus further improvement of the technique is required in order to manufacture a steel sheet having ultra fine crystal grains. Also, whereas rapid cooling necessitated in manufacturing a hot-rolled steel sheet having ultra fine crystal grains requires an impact pressure of the cooling water striking against a surface of a steel sheet to have at least a predetermined value, the technique disclosed in Patent Document 3 only specifies an ejection angle of the rod-like cooling water supplied to the steel sheet. Furthermore, Patent Document 3 describes that since the cooling water sprayed over the steel sheet flows to a portion at which the steel sheet and the work roll contact with each other, it is possible to perform cooling right after the portion. However, the cooling water which flows on the steel sheet after striking there against is not sufficient enough for rapid cooling; so the cooling at this portion hardly contributes to forming ultra fine crystal grains. Therefore, it is difficult to manufacture a hot-rolled steel sheet having ultra fine crystal grains by simply applying the above techniques.

Accordingly, an object of the present invention is to provide: a cooling apparatus of a hot-rolled steel sheet; a cooling method of a hot-rolled steel sheet; a manufacturing apparatus of a hot-rolled steel sheet; and a manufacturing method of a hot-rolled steel sheet, which are capable of manufacturing a hot-rolled steel sheet having ultra fine crystal grains.

Means for Solving the Problems

The inventors of the present invention conducted a research on manufacturing of a hot-rolled steel sheet having ultra fine crystal grains (, hereinafter sometimes referred to as an "ultra fine grain steel"), and obtained the following findings.

(1) As shown in FIG. 10, when completing cooling of a steel sheet to 720° C. within 0.2 second after the steel sheet has been rolled within a temperature range of $Ar_3$ point or more, it is possible to render crystal grains even finer.

(2) In order to complete cooling which causes a temperature decline by 100° C., for example, from 820° C., which is above $Ar_3$ point, to 720° C., within 0.2 second after rolling, it is necessary to carry out rapid cooling at an average cooling rate of 500° C./s or more and it is preferable to carry out rapid cooling at an average cooling rate of 600° C./s or more. Here, when defining as L1, a length in a transporting direction of a steel sheet, of a region from a rolling reduction point in a final stand of a row of hot finish rolling mills (, the rolling reduction point referring to a lower dead center of a work roll in contact with an upper surface of a rolled steel sheet, and an upper dead center of work roll in contact with a lower surface of a rolled steel sheet; the same shall apply hereinafter), to an exit side of a housing post of the final stand (; the region may be referred to as a "within-stand region", hereinafter); defining as L2, a length in the transporting direction of the steel sheet, of a rapidly coolable zone in the within-stand region; defining a cooling rate in the zone as V1; defining as L3, a length in the transporting direction of the steel sheet, of a zone in the within-stand region in which rapid cooling is difficult; and defining a cooling rate in the zone as V2, the cooling rate represented by $\{L2\times V1+L3\times V2\}/L1$ is an average cooling rate. In a case of cooling a steel sheet at a cooling rate of 600° C./s, the amount of time required for lowering a temperature of the steel sheet by 100° C. is 0.167 second. Therefore, in order to complete cooling within 0.2 second, it is necessary to start cooling within 0.033 second after rolling. For example, when the steel sheet is moved at a rate of 10 m/s, a distance in which the steel sheet moves within 0.033 second is 0.33 m. Therefore, it is preferable that rapid cooling after rolling be started from within a position corresponding to the radius of the work roll in the final stand of the row of hot-rolling mills, and that cooling be almost continuously performed at least within the final stand of the row of hot-rolling mills.

(3) For example, when a rolling rate of a steel sheet is 10 m/s, a distance in which the steel sheet moves within 0.2 second is 2 m. And a common distance between a rolling reduction point in a final stand of a row of hot finish rolling mills and an exit side of a housing post in the final stand is also approximately 2 m. Thus, the rapid cooling required must be performed mostly within the final stand. Further, from a metallurgical point of view, it is desired to perform cooling at an earlier time within the time period of 0.2 second, and to start cooling from a position closer to the rolling reduction point of the final stand. However, as typified by the area which is extremely close to the rolling reduction point, there are some areas between the rolling reduction point and the exit side of the housing post in the final stand, in which areas rapid cooling is difficult. Therefore, if taken into account the areas in which rapid cooling is difficult, in order to secure an average cooling rate of 500° C./s in the area from the rolling reduction point in the final stand to the exit side of the stand, the cooling rate in the rapidly coolable range needs to be increased (, the rapidly coolable range referring to the region excluding the area in which rapid cooling is difficult, from the region between the rolling reduction point and the exit side of the stand; the same shall apply hereinafter).

(4) There is a correlation between a pressure at which cooling water sprayed over the steel sheet strikes against the steel sheet (i.e. surface pressure) and the cooling rate of the steel sheet (see FIG. 5); thus it is possible to increase the cooling rate of the steel sheet by increasing the pressure at which cooling water strikes against the steel sheet. For this reason, an average cooling rate in the area from the rolling reduction point in the final stand of the row of hot finish rolling mills, to the exit side of the stand should be, for example, 500° C./or more. And to have the average cooling rate of the rapidly coolable region in the within-stand region as 500° C./s or more, it is necessary to spray high-pressure water over the steel sheet and to perform nuclear boiling cooling of the steel sheet.

Further, the inventors studied an impact pressure on the steel sheet of the high-pressure water, which enables securing of the average cooling rate of 500° C./s in the within-stand region in a case when there is an area in the within-stand region in which rapid cooling is difficult. In this study, it was supposed that a sheet passing rate was 10 m/s and a sheet thickness was 3 mm. The results are shown in Table 1. The results of a case when it was supposed that there were no areas in the within-stand region in which rapid cooling was difficult (Test No. 1) were also shown in Table 1.

TABLE 1

| Test No. | L1 [m] | L2 [m] | L3 [m] | X | Impact pressure [kPa] | Cooling rate [° C./s] | Passing time [s] | Temperature decline [° C.] |
|---|---|---|---|---|---|---|---|---|
| 1 | 2 | 2 | 0 | 1 | 2.5 | 500 | 0.2 | 100 |
| 2 | 2 | 1.65 | 0.35 | 0.325 | 3.44 | 608 | 0.165 | 100 |
| 3 | 2 | 1.65 | 0.35 | 0.325 | 3.5 | 613 | 0.165 | 101 |
| 4 | 2 | 1 | 1 | 0.5 | 7.94 | 1003 | 0.1 | 100 |
| 5 | 2 | 1 | 1 | 0.5 | 8.0 | 1007 | 0.1 | 101 |
| 6 | 2 | 0.635 | 1.365 | 0.3175 | 16.92 | 1579 | 0.0635 | 100 |

In Table 1, L1 stands for a length of the within-stand Region in the transporting direction of the steel sheet. L2 stands for a length of the rapidly coolable range in the within-stand region, in the transporting direction of the steel sheet. L3 stands for a length, in the transporting direction of the steel sheet, of the area in the within-stand region in which rapid cooling is difficult. And, X represents the ratio of L2/L1. Further, in Table 1, the cooling rate refers to a cooling rate in the rapidly coolable region in the within-stand region. The sheet passing time refers to a time required for any point on the surface of the steel sheet to pass the rapidly coolable range in the within-stand region. And the temperature decline refers to an amount of temperature decline of the steel sheet cooled in the rapidly coolable region.

As shown in Table 1, when there existed no areas in The within-stand region in which rapid cooling was difficult, it was possible to have the average cooling rate of 500° C./s in the within-stand region by setting the required impact pressure at 2.5 kPa (Test No. 1). On the other hand, when a rate of the rapidly coolable range in the within-stand region declined to 0.825, it was possible to have the cooling rate of 608° C./s in the within-stand region, exceeding 500° C./s, for example, by setting the impact pressure at 3.44 kPa (Test No. 2). Further, even when the rate of the rapidly coolable range in the within-stand region declined to 0.825 by not performing rapid cooling in the region from the rolling reduction point to the position which is only a radius of the work roll in the final stand away toward the downstream side in the transporting direction of the steel sheet, it was possible to have the average cooling rate of 613° C./s in the within-stand region, exceeding 500° C./s with the impact pressure at 3.5 kPa (Test No. 3). Still further, when the rate of the rapidly coolable range in the within-stand region declined to 0.5, it was possible to give the average cooling rate of 500° C./s, or more in the within-stand region, (e.g. 1003° C./s in Test No. 4, and 1007° C./s in Test No. 5), for example, by setting the impact pressure at 7.94 kPa or 8.0 kPa. Furthermore, when the rate of the rapidly coolable range in the within-stand region declined to 0.3175, it was possible to have the average cooling rate of 1579° C./s in the within-stand region, exceeding 500° C./s, for example, by setting the impact pressure at 16.92 kPa (Test No. 6).

The present invention has been made based on the above described findings, and the summary of the invention is as follows.

Hereinafter, the present invention will be described below. Although the reference symbols in the accompanying drawings are shown in parentheses for the purpose of easy understanding of the invention, the invention is not limited to an embodiment shown in the drawings.

A first aspect of the invention is a cooling apparatus of a hot-rolled steel sheet, which is disposed on a downstream side of a rolling reduction point in a final stand (11*g*) of a row (11) of hot finish rolling mills, and which comprises headers (21, 22) provided with a plurality of cooling nozzles (21*a*, 21*a*. . . , 22*a*, 22*a*, . . .) capable of spraying high-pressure water over an upper surface and a lower surface of a steel sheet (1) being transported on a pass line, wherein the cooling apparatus is configured in a manner capable of spraying the high-pressure water from the cooling nozzles, in a transporting direction of the steel sheet, over the upper surface and the lower surface of the steel sheet in a zone from the rolling reduction point in the final stand to an exit side of a housing post in the final stand; and the cooling apparatus is configured in a manner capable of continuously spraying the high-pressure water in the transporting direction of the steel sheet (1), at least in the zone from within a position corresponding to a radius of a work roll (11*gw*, 11*gw*) in the final stand (11*g*) to the exit side of a housing post (11*gh*) in the final stand, when defining as L1, a length in the transporting direction of the steel sheet, of the zone from the rolling reduction point in the final stand to the exit side of the housing post in the final stand; defining as L2, a length in the transporting direction of the steel sheet, of a zone of a high-pressure water jet in which the high-pressure water is continuously sprayed over the steel sheet, within the zone from the rolling reduction point in the final stand to the exit side of the housing post in the final stand; and defining the ratio of L2/L1 as X, an average value Ps [kPa], in the transporting direction of the steel sheet, of an impact pressure of the high-pressure water on the surface of the steel sheet, in the zone of a high-pressure water jet satisfies a below formula (1), on the above upper surface and lower surface of the steel sheet:

$$Ps \geqq 2.5X^{(-1/0.6)} \quad (1)$$

Here, the "rolling reduction point" refers to a lower dead center of a work roll (11*gwu*) which contacts with the upper surface of the steel sheet (1), and an upper dead center of a work roll (11*gwd*) which contacts with the lower surface of the steel sheet. Further, the "downstream side" refers to a downstream side in the transporting direction of the steel sheet (1). The "high-pressure water" refers to jetted water having a pressure with which to perform nuclear boiling cooling of the steel sheet (1). In the present invention, a strict start point in the zone in which the high-pressure water can be continuously sprayed (i.e. a most upstream point in the transporting direction of the steel sheet (1), which may be referred to as a "rapid-cooling start point, hereinafter") is on the most upstream side of an area in which the high-pressure water directly strikes against the steel sheet; in other words, it is a point closest to the rolling reduction point. When the nozzles for spraying high-pressure water are arranged most closely to the work roll in the final stand, the point at which a tangential line drawn on a surface of the work roll from a center of an ejection hole of the nozzle reaches the surface of the steel sheet, is equivalent to the strict start point of the zone where the high-pressure water can be continuously sprayed. Still further, the "exit side of a housing post in the final stand" refers to an outer surface of the housing post (11*gh*) in the final stand (i.e. an outer surface on the downstream side in the transporting direction of the steel sheet). Also, "configured in a manner capable of spraying high-pressure water from the cooling nozzles, in a transporting direction of the steel sheet" means that the cooling apparatus is configured to be capable of spraying the high-pressure water over the upper surface and the lower surface of the steel sheet (1) from a plurality of the nozzles (21*a*, 21*a*, . . . , 22*a*, 22*a*, . . . ) which are disposed in the transporting direction of the steel sheet with a predetermined spacing. Additionally, as shown in FIG. 4, the "position corresponding to the radius of the work roll in the final stand" refers to a position which is only a radius of the work roll (11*gw*, 11*gw*) in the final stand away toward the downstream side in the transporting direction of the steel sheet (1), from the rolling reduction point at which the steel sheet (1) to be rolled and the work roll (11*gw*, 11*gw*) in the final stand contact with each other. Furthermore, "from within a position corresponding to the radius of the work roll in the final stand-"means that the high-pressure water sprayed from the nozzles (21*a*, 21*a*, . . . ,22*a*, 22*a*, . . . ) is supplied to the upper surface and the lower surface of the steel sheet (1) which exists between the rolling reduction point and the position corresponding to the radius of the work roll in the final stand (on the side closer to the rolling reduction point than to the position corresponding to the radius of the work roll in the final stand). Moreover, "configured in a manner capable of the continuously spraying high-pressure water in the transporting direction of the steel sheet (1) at least in the zone from within a position corresponding to the radius of the work roll (11*gw*, 11*gw*)in the final stand (11*g*), to the exit side of the housing post (11*gh*) og the final stand" means, for the example as shown in FIG.2, 4, and 7, that the cooling apparatus is the configured to be capable of spraying high-pressure water without having an area in the zone from the rapid cooling-start point located within the position corresponding to the radius of the work roll (11*gw*, 11*gw*), to the exit side of the housing post (11*gh*), in which the area rapid cooling of the steel sheet (1) is difficult (or the region in which rapid cooling is impossible). Additionally the "average value in the transporting direction of the steel sheet, of an impact pressure of the high-pressure water on the surface of the steel sheet"

refers to a value which is obtained by measuring or calculating the impact pressure of the high-pressure water that the surface of the steel sheet is subjected to, along a line segment in the transporting direction of the steel sheet at any position in the width direction of the steel sheet, or for example, in the middle position of the width direction; and then by averaging, in a predetermined region, the impact pressure thus measured or calculated. In order to uniformly cool the steel sheet in the width direction of the steel sheet, it is desirable to equalize this average value in the transporting direction of the steel sheet, in every region in the width direction of the steel sheet. On a surface which has at least a width equivalent to the nozzle pitch, as well, the impact pressure should be equal to the impact pressure on the surface of the steel sheet which is determined on the line segment. Therefore, in determining the above average value in the transporting direction of the steel sheet, the average impact pressure on the surface of the steel sheet that one nozzle has may be determined in every row of nozzles aligned in the transporting direction of the steel sheet, and then it may be averaged in the transporting direction of the steel sheet (see FIGS. 4 and 7). In the present invention, as shown in FIG. 6, for example, when defining a nozzle pitch in the width direction of the steel sheet as A; and defining a nozzle pitch in the transporting direction of the steel sheet, in other words a space between the headers, as B, the average impact pressure on the surface of the steel sheet that one nozzle has can be calculated by dividing a force (impact force) of the cooling water striking against a parallelogram region whose area is represented by A×B, by the parallelogram area A×B. Further, the above formula (1) presupposes, for example, that rapid cooling of the steel sheet is started from inside the final stand and is obtained by mathematizing the idea that an ultra fine grain steel can be manufactured by raising the average cooling rate in the rapidly coolable region in the within-stand region even if there exists an area in the within-stand region in which rapid cooling is difficult. Therefore, the formula (1) is applicable to the rapid cooling from inside the final stand; and, this formula can also be applicable to the rapid cooling outside the final stand. In formula (1), the value "2.5" derives from a Ps value (2.5 kPa) which is preferably satisfied in a case when there are no areas in the within-stand region where rapid cooling is difficult. Further, 'X" refers to a rate of the rapidly coolable range in the within-stand region. The value "0.6" derives from a relationship between the average cooling rate of the steel sheet and the average value, in the transporting direction of the steel sheet, of the impact pressure of the high-pressure water on the surface of the steel sheet (i.e. a relationship that the average cooling rate of the steel sheet is proportional to the $0.6^{th}$ power of the average value in the transporting direction of the steel sheet, of the impact pressure of the high-pressure water on the surface of the steel sheet). And the value "−1" originates in the necessity that the average cooling rate be inversely proportional to X. A derivation method of the above formula (1) will be described below.

Since it is necessary to raise the average cooling rate by making the average cooling rate inversely proportional to the rate X at which cooling is possible, in a case of having the average cooling rate of 500° C./s in the within-stand region, the average cooling rate V [° C./s] and the rate X need to satisfy the below formula (A):

$$V=500/X \quad \text{(A)}$$

Further, the relationship between the average cooling rate V of the steel sheet, and the average value Ps, in the transporting direction of the steel sheet, of the impact pressure of the high-pressure water on the surface of the steel sheet may be represented by the below formula (B):

$$V=289\cdot Ps^{0.6} \quad \text{(B)}$$

Since the relation, $289\cdot Ps^{0.6}=500/X$ can be obtained from the formulas (A) and (B), rearrangement of this results in the below:

$$Ps^{0.6}\approx 1.73/X$$

$$Ps\approx 2.5/X^{(1/0.6)}$$

Therefore, in order to have the average cooling rate of 500° C. or more in the within-stand region, it is necessary to meet the following:

$$Ps\geqq 2.5X^{(-1/0.6)} \quad (1)$$

The formula (1) can be derived in this way.

In addition, in the above first aspect of the present invention, the cooling apparatus is preferably configured in a manner capable of continuously spraying the high-pressure water in the transporting direction of the steel sheet (1), at least in the zone from within a position corresponding to the radius of the work roll (11*gw*, 11*gw*) in the final stand to the exit side of the housing post (11*gh*) of the final stand.

Further, in the first aspect of the present invention, among the headers disposed at least between the rolling reduction point in the final stand and the exit side of the housing post in the final stand, the header arranged closely to the work roll in the final stand is preferably configured to be movable to the position where the replacement of the work roll in the final stand is possible.

Here, as shown in FIG. 4, the "position corresponding to the radius of the work roll in the final stand" refers to a position which is only a radius of the work roll in the final stand away toward the downstream side in the transporting direction of the steel sheet, from the rolling reduction point at which the steel sheet (1) to be rolled and the work roll (11*gw*, 11*gw*) in the final stand contact with each other. Further, "from within a position corresponding to the radius of the work roll in the final stand" means that the high-pressure water sprayed from the nozzles (21*a*, 21*a*, . . . , 22*a*, 22*a*, . . . ) is supplied to the upper surface and the lower surface of the steel sheet (1) which exists between the rolling reduction point and the position corresponding to the radius of the work roll in the final stand (on a side closer to the rolling reduction point than to the position corresponding to the radius of the work roll in the final stand). Still further, "configured in a manner capable of continuously spraying high-pressure water in the transporting direction of the steel sheet (1) at least in the zone from within a position corresponding to the radius of the work roll (11*gw*, 11*gw*) in the final stand (11*g*), to the exit side of the housing post (11*gh*) of the final stand" means, for example as shown in FIGS. 2, 4, and 7, that the cooling apparatus is configured to be capable of spraying high-pressure water without having an area in the zone from the cooling-start point located within the position corresponding to the radius of the work roll (11*gw*, 11*gw*), to the exit side of the housing post (11*gh*), in which area rapid cooling of the steel sheet (1) is difficult (or a region in which rapid cooling is impossible).

In addition, in the first aspect of the present invention, the average value, in the transporting direction of the steel sheet, of the impact pressure of the high-pressure water on the surface of the steel sheet, in the above described zone, is preferably 3.5 kpa or more on the upper surface and the lower surface.

Further, in the first aspect of the present invention, the average value, in the transporting direction of the steel sheet, of the impact pressure of the high-pressure water on the surface of the steel sheet, in the above described zone, is preferably 3.5 kPa or more on the upper surface and the lower surface.

Herein, the "average value in the transporting direction of the steel sheet, of the impact pressure of the high-pressure water on the surface of the steel sheet" refers to a value which is obtained by measuring or calculating the impact pressure of the high-pressure water that the surface of the steel sheet is subjected to, along a line segment in the transporting direction of the steel sheet at any position in the width direction of the steel sheet, or for example, in the middle position of the width direction; and then by averaging, in a predetermined region, the impact pressure thus measured or calculated. In order to uniformly cool the steel sheet in the width direction of the steel sheet, it is desirable to equalize this average value in the transporting direction of the steel sheet, in every region in the width direction of the steel sheet. On a surface which has at least a width equivalent to the nozzle pitch, as well, the impact pressure should be equal to the impact pressure on the surface of the steel sheet which is determined on the line segment. Therefore, in determining the above average value in the transporting direction of the steel sheet, the average impact pressure on the surface of the steel sheet that one nozzle has may be determined in every row of nozzles aligned in the transporting direction of the steel sheet, and then it might be averaged in the transporting direction of the steel sheet (see FIGS. 4 and 7). In the present invention, as shown in FIG. 6, for example, when defining a nozzle pitch in the width direction of the steel sheet A; and the defining a nozzle pitch in the transporting direction of the steel sheet, in other words a space between the headers, as B, the average impact pressure on the surface of the steel sheet that on nozzle has can be calculated by dividing a force (impact force) of the cooling water striking against a parallelogram region whose area is represented by A×B, by the parallelogram area A×B.

Still further, in the first aspect of the present invention, it is preferable that a rapidly cooled region having a length of over 0.75 m in the transporting direction of the steel sheet exist in the zone of a high-pressure water jet on both upper surface side and lower surface side of the steel sheet.

Furthermore, in the first aspect of the present invention, the nozzles (21*a*, 21*a*, . . . , 22*a*, 22*a*, . . . ) are preferably flat spray nozzles.

Moreover, in the first aspect of the present invention, a space for discharging cooling water is preferably secured between both end surfaces of the cooling apparatus (20) in the width direction of the steel sheet and both end surfaces of the final stand (11*g*) in the width direction of the steel sheet.

Here, "both end surfaces of the cooling apparatus (20) in the width direction" refers to an outer surface of the cooling apparatus (20) in terms of both end sides in the width direction of the steel sheet (1). And "both end surfaces of the final stand (11*g*) in the width direction of the steel sheet" refers to an inner surface of the housing post (11*gh*) of the final stand in terms of both end sides in the width direction of the steel sheet (1).

Additionally, in the first aspect of the present invention, the header (21) and the nozzles (21*a*, 21*a*, . . . ) arranged on the upper surface side of the steel sheet (1) are unified with an upper surface guide (23) arranged between the nozzles and the pass line.

Here, the "upper surface guide (23)" is a member of the cooling apparatus (20) which is disposed on the upper surface side of the steel sheet (1) for the purpose of, for example, preventing the steel sheet (1) rolled in the final stand (11*g*) from striking against the work roll (11*gwu*) in the final stand or the nozzles (21*a*, 21*a*, . . . ) of the cooling apparatus (20).

Also, in the first aspect of the present invention, the header (22) and the nozzles (22*a*, 22*a*, . . . ) arranged on the lower surface side of the steel sheet (1) are preferably unified with a lower surface guide (24) arranged between the nozzles and the pass line.

Here, the "lower surface guide (24)" is a member of the cooling apparatus (20) which is disposed on the lower surface side of the steel sheet for the purpose of, for example, preventing the steel sheet (1) rolled in the final stand (11*g*) from striking against the work roll (11*gwd*) in the final stand or the nozzles (22*a*, 22*a*, . . . ) of the cooling apparatus (20).

In the first aspect of the present invention, it is preferable that a plurality of the headers (21, 31, 22, 32) be provided, and that at least a part of the headers be configured in a manner capable of supplying cooling water all at once, to the nozzles (31*a*, 31*a*, . . . , 32*a*, 32*a*, . . . ) which are arranged, in a form of a plurality of rows, respectively in the transporting direction and in the width direction of the steel sheet (1).

Further, in the first aspect of the present invention, in which at least a part of the headers is configured in a manner capable of supplying cooling water all at once, to the nozzles, which are arranged, in a form of a plurality of rows, respectively in the transporting direction and in the width direction of the steel sheet, it is preferable that a plurality of the headers (21, 31) be disposed on the upper surface side of the steel sheet; and that among the headers disposed on the upper surface side of the steel sheet, at least the header (31) which is disposed on the most upstream side in the transporting direction of the steel sheet be configured in a manner capable of supplying cooling water all at once, to the nozzles (31*a*, 31*a*, . . . ) which are arranged, in a form of a plurality of rows, respectively in the transporting direction and in the width direction of the steel sheet.

Also, in the first aspect of the present invention, in which at least a part of the headers is configured in a manner capable of supplying cooling water all at once, to the nozzles, which are arranged, in a form of a plurality of rows, respectively in the transporting direction and in the width direction of the steel sheet, it is preferable that a plurality of the headers (22, 32) be disposed on the lower surface side of the steel sheet; and that among the headers disposed on the lower surface side of the steel sheet, at least the header (32) which is disposed on the most upstream side in the transporting direction of the steel sheet be configured in a manner capable of supplying cooling water all at once, to the nozzles (32*a*, 32*a*, . . . ) which are arranged, in a form of a plurality of rows, respectively in the transporting direction and in the width direction of the steel sheet.

A second aspect of the present invention is a cooling method of a hot-rolled steel sheet, wherein a steel sheet is cooled by using the cooling apparatus of a hot-rolled steel sheet according to the first aspect of the present invention described above.

A third aspect of the present invention is a manufacturing apparatus (10) of a hot-rolled steel sheet comprising a final stand (11*g*) of a row (11) of hot finish rolling mills, and the cooling apparatus (20, 20') of a hot-rolled steel sheet according to the above described first aspect of the present invention, in the order mentioned in the transporting direction of the steel sheet (1).

A fourth aspect of the present invention is a manufacturing method of a hot-rolled steel sheet comprising a process to treat the steel sheet (1) rolled in the final stand (11*g*) of the row (11) of hot finish rolling mills by using the manufacturing apparatus (10) of a hot-rolled steel sheet according to the above third aspect of the present invention.

Effects of the Invention

In the present invention, upper and lower surfaces of a steel sheet is rapidly cooled by spraying high-pressure water in the within-stand region so as to meet the above formula (1); thereby enabling rapid cooling of a rolled steel sheet while inhibiting, for example, recovery of a microstructure of austenite. Therefore, with the present invention, it is possible to provide: a cooling apparatus of a hot-rolled steel sheet; a cooling method of a hot-rolled steel sheet; a manufacturing apparatus of a hot-rolled steel sheet; and a manufacturing method of a hot-rolled steel sheet, which are capable of manufacturing a hot-rolled steel sheet having ultra fine crystal grains.

| Description of the Symbols | |
|---|---|
| 1 | steel sheet |
| 10 | manufacturing apparatus of hot-rolled steel sheet |
| 11 | row of hot finish rolling mills |
| 11g | final stand |
| 11gh | housing post of final stand |
| 11gw | work roll of final stand |
| 11gwu | work roll of final stand |
| 11gwd | work roll of final stand |

-continued

| Description of the Symbols | |
|---|---|
| 12 | transporting roll |
| 13 | pinch roll |
| 20, 20' | cooling apparatus of hot-rolled steel sheet |
| 21 | header |
| 21a | nozzle |
| 22 | header |
| 22a | nozzle |
| 23 | upper surface guide |
| 24 | lower surface guide |
| 30 | cooling apparatus of hot-rolled steel sheet |
| 31 | set type header |
| 31a | nozzle |
| 32 | set type header |
| 32a | nozzle |

MODES FOR CARRYING OUT THE INVENTION

Hereinafter, the present invention will be described based on the embodiments shown in the accompanying drawings.

Figure 1:
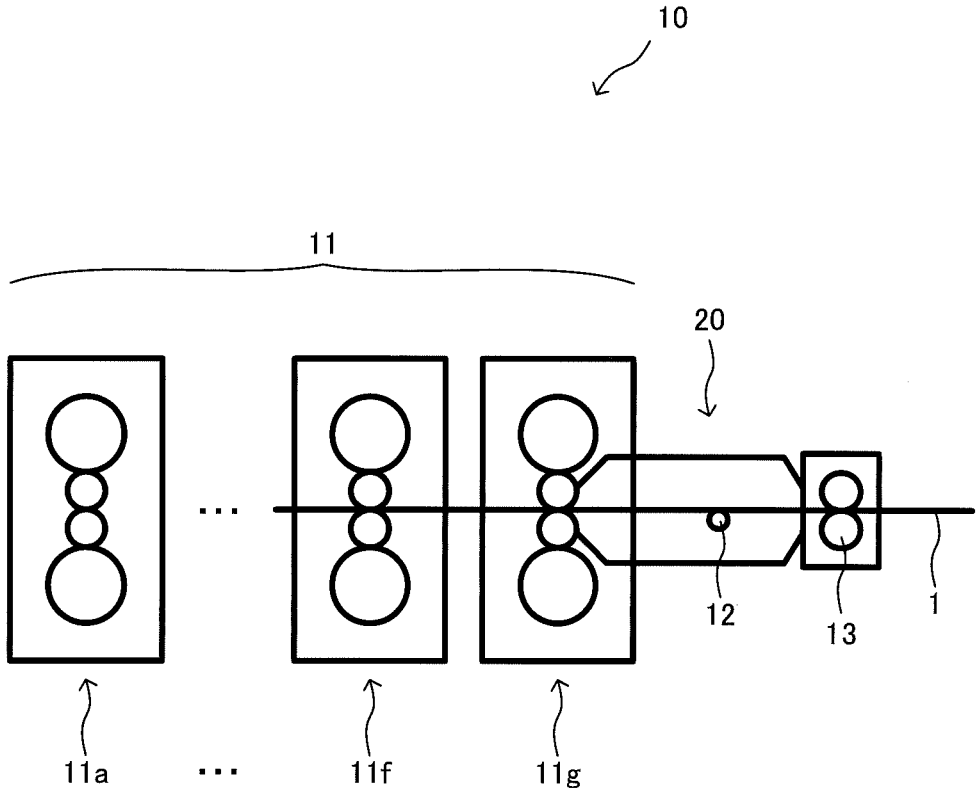
FIG. 1 is a schematic view showing a part of a manufacturing apparatus of a hot-rolled steel sheet according to the present invention.

FIG. 1 schematically shows a cooling apparatus (20) of a hot-rolled steel sheet of the present invention, and a part of a manufacturing apparatus (10) of a hot-rolled steel sheet of the present invention which comprises the cooling apparatus (20). In FIG. 1, a steel sheet 1 is transported from a left on the sheet of paper (upstream side) to a right (downstream side), a direction from a top to a bottom on the sheet of paper being a vertical direction. Hereinafter, a direction from the upstream side to the downstream side may be referred to as a transporting direction; and a direction of a width of the steel sheet being transported, which is orthogonal to the transporting direction, may be referred to as a width direction of a steel sheet. Further, reference symbols may be omitted in the below descriptions of the drawings for the purpose of easy viewing.

As shown in FIG. 1, the manufacturing apparatus 10 of a hot-rolled steel sheet (, which may be simply referred to as a "manufacturing apparatus 10", hereinafter) comprises: a row 11 of hot finish rolling mills; a cooling apparatus 20 of the present invention (, which may be simply referred to as a "cooling apparatus 20", hereinafter); a transporting roll 12; and a pinch roll 13. Further, a heating furnace, a row of rough rolling mills, and the like, the figures and descriptions of which are omitted, are arranged on the upstream side of the row 11 of hot finish rolling mills and set better conditions of a steel sheet to be rolled by the row 11 of hot finish rolling mills. On the other hand, another cooling apparatus or various kinds of equipment such as a coiler to ship the steel sheet as a steel sheet coil, are arranged on the downstream side of the pinch roll 13.

A hot-rolled steel sheet is generally manufactured in the following way. A rough bar which has been taken from a heating furnace and has been rolled by a rough rolling mill to have a predetermined thickness is rolled continuously by the row 11 of hot finish rolling mills to a predetermined thickness, while controlling a temperature. After that, it is rapidly cooled by the cooling apparatus 20. Herein, the cooling apparatus 20 is disposed from inside the housing post 11*gh* of the final stand in the row 11 of hot finish rolling mills, in a manner as close to the work rolls 11*gw*, 11*gw* in the final stand as possible (; hereinafter, the work roll 11*gw* in contact with the upper surface of the steel sheet 1 may be referred to as a "work roll 11*gwu*", and the work roll 11*gw* in contact with the lower surface of the steel sheet 1 may be referred to as a "work roll 11*gwd*"). Then, the steel sheet having passed through the pinch roll 13 is cooled by another cooling apparatus to a predetermined coiling temperature to be coiled by a coiler.

As described above, the manufacturing apparatus 10 comprises the row 11 of hot finish rolling mills as described above. In an embodiment of the present invention, seven rolling mills (11*a*, 11*b*, 11*c*, . . . , 11*g*) are aligned along the transporting direction. In each of the rolling mills 11*a*, 11*b*, . . . , 11*g*, a rolling reduction and the like are set, so that in the rolling mills which form each stand, the steel sheet can meet conditions for thickness, mechanical properties, surface quality, and the like which are required as a final product.

Figure 2:
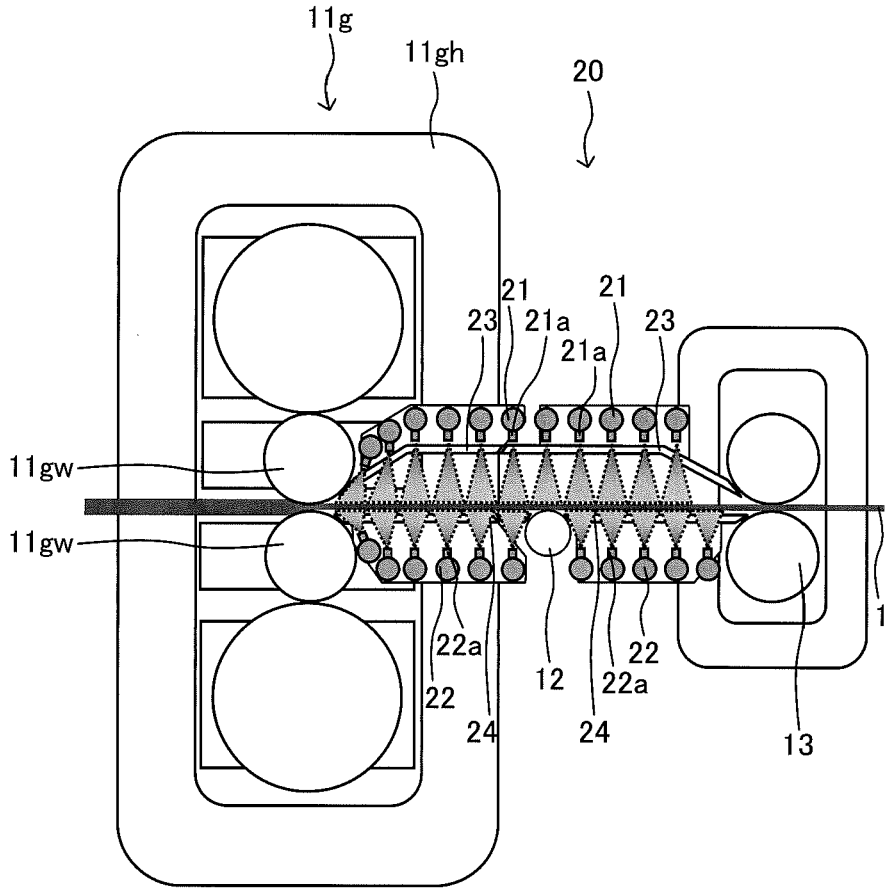
FIG. 2 is an enlarged view of an area taken from FIG. 1, in which area the cooling apparatus of a hot-rolled steel sheet of the present invention is disposed.
Figure 3:
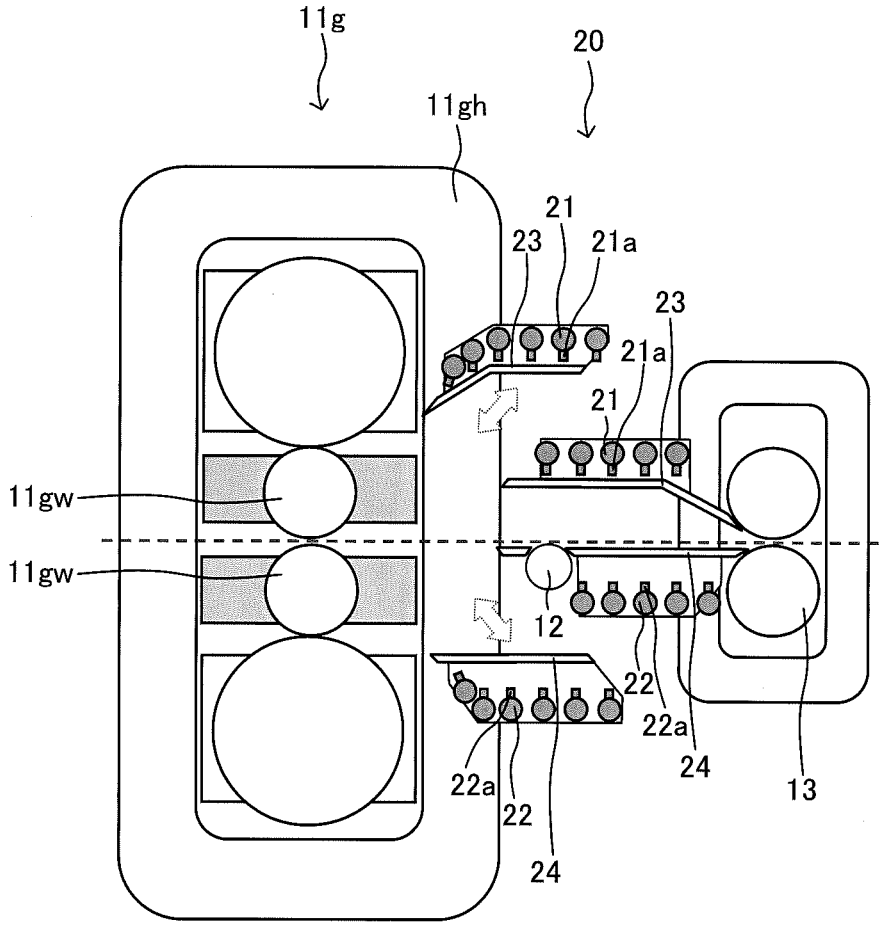
FIG. 3 is a view showing an embodiment of the cooling apparatus of a hot-rolled steel sheet of the present invention.
Figure 4:
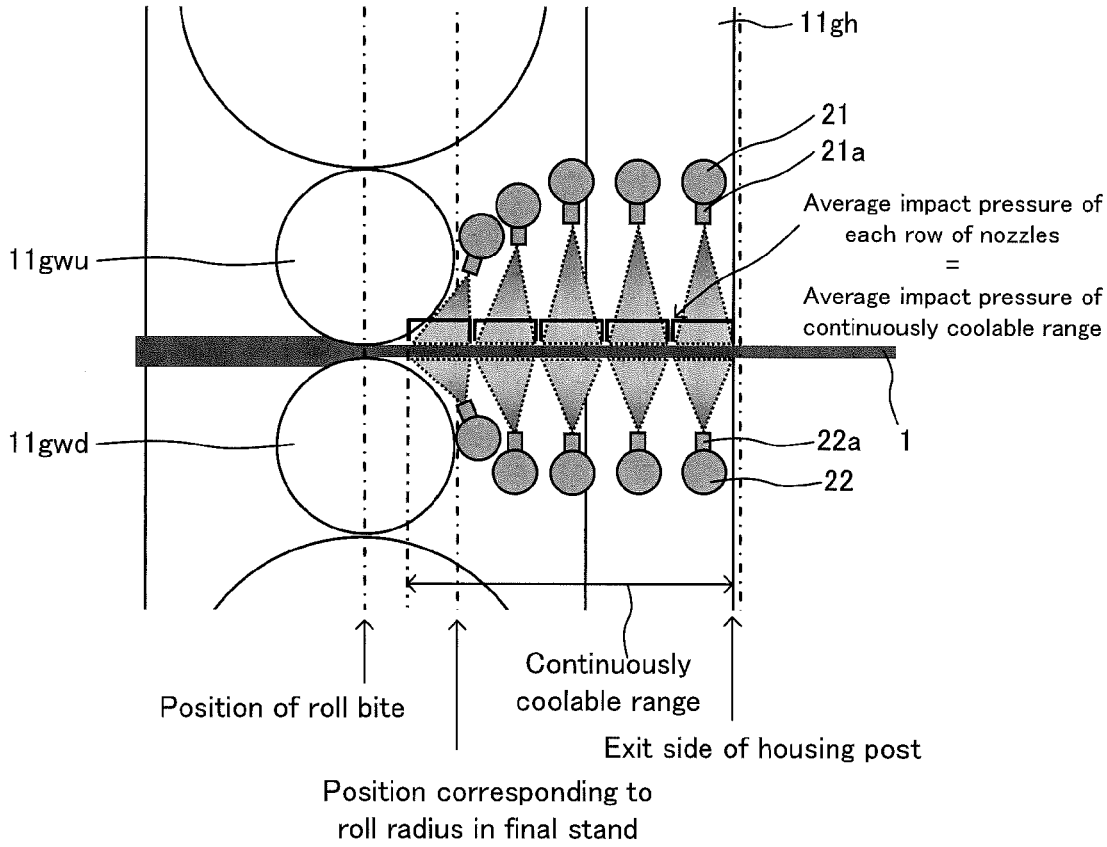
FIG. 4 is a conceptual view of a position corresponding to the radius of a work roll in a final stand, and an exit side of a housing post in the final stand, together with an average value, in a transporting direction of a steel sheet, of an impact pressure of high-pressure water on a surface of the steel sheet.

FIGS. 2 and 3 are enlarged views of an area in which the cooling apparatus 20 is disposed. FIG. 2 shows a manner in which the cooling apparatus 20 rapidly cools the upper surface and the lower surface of the steel sheet immediately after the steel sheet passes the rolling reduction point in the final stand 11*g*. A dotted line in FIG. 2 shows the high-pressure water. On the other hand, FIG. 3 shows a manner in which to replace the work rolls 11*gw*, 11*gw* in the final stand 11*g* of the cooling apparatus 20. Further, FIG. 4 is a view illustrating the position corresponding to the radius of the work roll in the final stand, and the exit side of the housing post 11*gh* in the final stand, together with the average value, in the transporting direction of the steel sheet, of the impact pressure of high-pressure water on the surface of the steel sheet (; the average value may be simply referred to as an "average value of an impact pressure of cooling water", or an "average impact pressure", hereinafter"). A left side on the sheet of paper of FIG. 4 is the upstream side in the transporting direction of the steel sheet, whereas a right side on the sheet of paper of FIG. 4 is the downstream side in the transporting direction of the steel sheet. Specific descriptions of the cooling apparatus 20 will be given below, with reference to FIGS. 2 to 4.

As shown in FIGS. 2 and 3, the cooling apparatus 20 is disposed on the downstream side of the final stand 11*g* in the row 11 of hot finish rolling mills. The cooling apparatus 20 comprises: headers 21, 21 attached with a plurality of flat spray nozzles 21*a*, 21*a*, . . . (, which may be simply referred to as a "nozzle 21*a*" etc., hereinafter), which spray high-pressure water over the upper surface of the steel sheet 1; and headers 22, 22 attached with a plurality of flat spray nozzles 22*a*, 22*a*, . . . (, which may be simply referred to as a "nozzle 22*a*" etc., hereinafter), which spray high-pressure water over the lower surface of the steel sheet 1. A plurality of the nozzles 21*a*, 21*a* . . . disposed in the width direction of the steel sheet at a predetermined pitch are attached to the header 21; and a plurality of the headers 21, 21, . . . are disposed in the transporting direction of the steel sheet at a predetermined pitch. Likewise, a plurality of the nozzles 22*a*, 22*a* . . . disposed in the width direction of the steel sheet at a predetermined pitch are attached to the header 22; and a plurality of the headers 22, 22, . . . are disposed in the transporting direction of the steel sheet at a predetermined pitch. The headers 21, 21, . . . are configured in a manner capable of supplying cooling water all at once to the plurality of the nozzles 21*a*, 21*a*, . . . disposed in the width direction of the steel sheet at a predetermined pitch; and the headers 22, 22, . . . are configured in a manner capable of supplying cooling water all at once to the plurality of the nozzles 22*a*, 22*a*, . . . disposed in the width direction of the steel sheet at a predetermined pitch. The two rows of the nozzles 21*a*, 21*a* on the upper surface side of the steel sheet 1, and the two rows of the nozzles 22*a*, 22*a* on the lower surface side of the steel sheet 1, respectively disposed on the most upstream side in the transporting direction of the steel sheet 1, are arranged in such a manner that an axis direction of each of the nozzles is crossing to a vertical surface so as to obliquely spray high-pressure water toward the upstream side in the transporting direction of the steel sheet 1. In the cooling apparatus 20, an angle to the vertical surface which an axis direction of the nozzles 21*a*, 22*a* disposed on the most upstream side in the transporting direction of the steel sheet makes (hereinafter, the angle being referred to as an "inclined angle to a vertical surface"), is larger than the inclined angle to the vertical surface given to the nozzles 21*a*, 22*a* which are adjacent to the nozzles 21*a*, 22*a* disposed on the most upstream side, and are adjacent to the downstream side in the transporting direction of the steel sheet. The upper surface guides 23, 23 for preventing the nozzles 21*a*, 21*a*, . . . and the steel sheet 1 from striking against each other are arranged between the nozzles 21*a*, 21*a*, . . . and the upper surface of the steel sheet 1; and the lower surface guides 24, 24 for preventing the nozzles 22*a*, 22*a*, . . . and the steel sheet 1 from striking against each other are arranged between the nozzles 22*a*, 22*a*, . . . and the lower surface of the steel sheet 1. In the cooling apparatus 20, the header 21 arranged closely to the work roll 11*gwu* in the final stand 11*g* are unified with the upper surface guide 23; and the header 22 arranged closely to the work roll 11*gwd* in the final stand 11*g* are unified with the upper surface guide 24. So, in replacing the work rolls 11*gw*, 11*gw* in the final stand, for example, it is possible to move the header 21 together with the upper surface guide 23 arranged closely to the work roll 11*gwu* in the final stand, and also to move the header 22 together with the lower surface guide 24 arranged closely to the work roll 11*gwd* in the final stand. And by this a space for a chock on the driving side (on a back side on the sheet of paper of FIG. 3) to come out to the operation side is created, enabling replacement of the rolls.

As shown in FIGS. 2 and 4, in rapidly cooling the steel sheet 1 by using the cooling apparatus 20, for example, the impact region of the high-pressure water sprayed from the nozzle 21*a* reaches the region closer to the side of the rolling reduction point than to the position corresponding to the radius of the work roll in the final stand 11*g*; and the impact region of the high-pressure water sprayed from the nozzle 22*a* reaches the region closer to the side of the rolling reduction point than to the position corresponding to the radius of the work roll in the final stand 11*g*. Further, as shown in FIGS. 2 and 3, in the cooling apparatus 20, the headers 21, 21, . . . which are attached with a plurality of the nozzles 21*a*, 21*a*, . . . disposed in the width direction of the steel sheet at a predetermined pitch, and the headers 22, 22, . . . which are attached with a plurality of the nozzles 22*a*, 22*a*, . . . disposed in the width direction of the steel sheet at a predetermined pitch are disposed in the transporting direction of the steel sheet at a predetermined pitch. Therefore, by using the cooling apparatus 20, it is possible to continuously spray the high-pressure water over the upper surface and the lower surface of the steel sheet 1 in the zone from within the position corresponding to the radius of the work roll in the final stand 11*g* to the exit side of the housing post 11*gh* of the final stand. By spraying the high-pressure water over the upper surface and the lower surface of the steel sheet 1, the high-pressure water can penetrate into a boiling film on the surface of the steel sheet even if there exists retained water on the surface of the steel sheet 1; therefore it becomes possible to perform nuclear boiling cooling (rapid cooling) of the steel sheet 1. That is to say, with this configuration of the cooling apparatus 20, the upper and lower surfaces of the steel sheet 1 having passed through the rolling reduction point can be continuously cooled more quickly and more strongly. Accordingly, with the present invention, it is possible to provide the cooling apparatus 20 which is capable of manufacturing an ultra fine grain steel.

Figure 5:
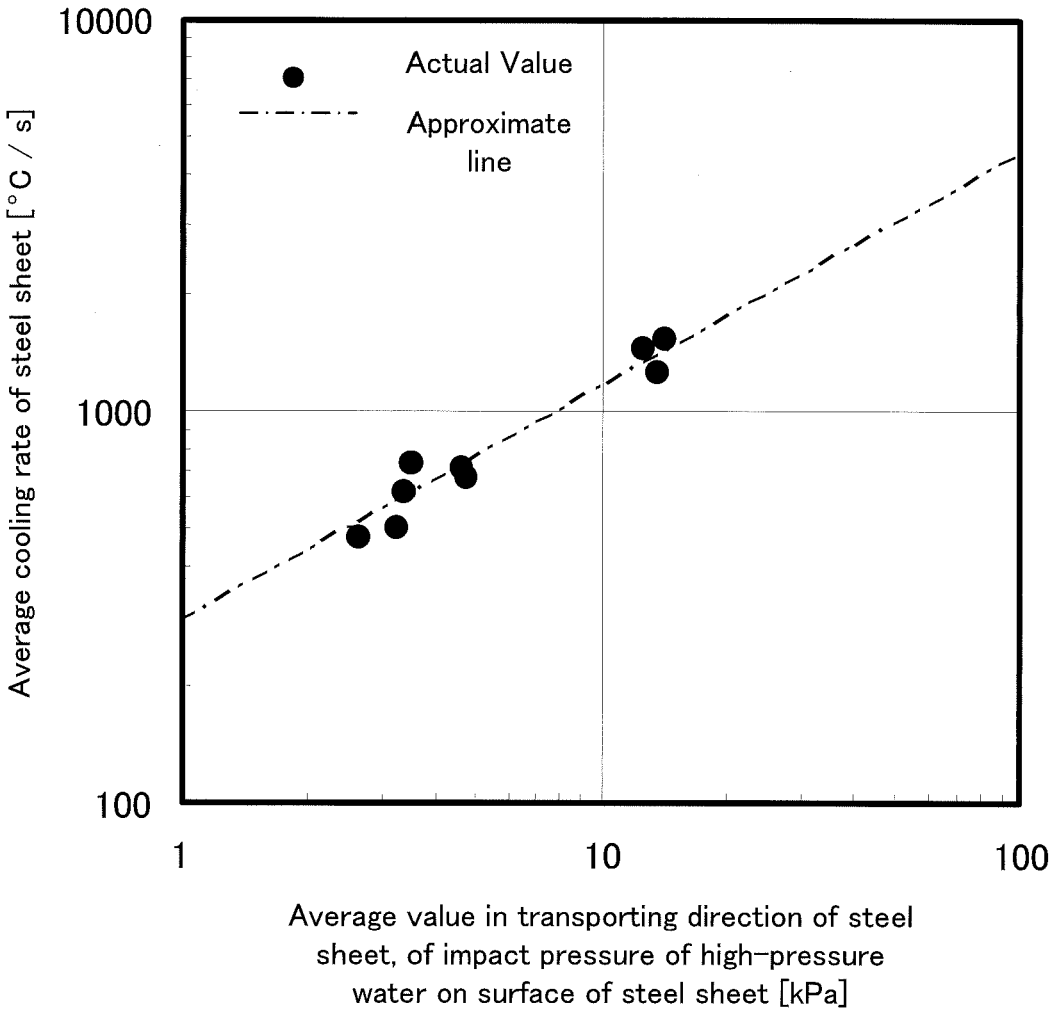
FIG. 5 is a view showing a relationship between the average value, in the transporting direction of the steel sheet, of the impact pressure of high-pressure water on the surface of the steel sheet and an average cooling rate of the steel sheet.
Figure 6:
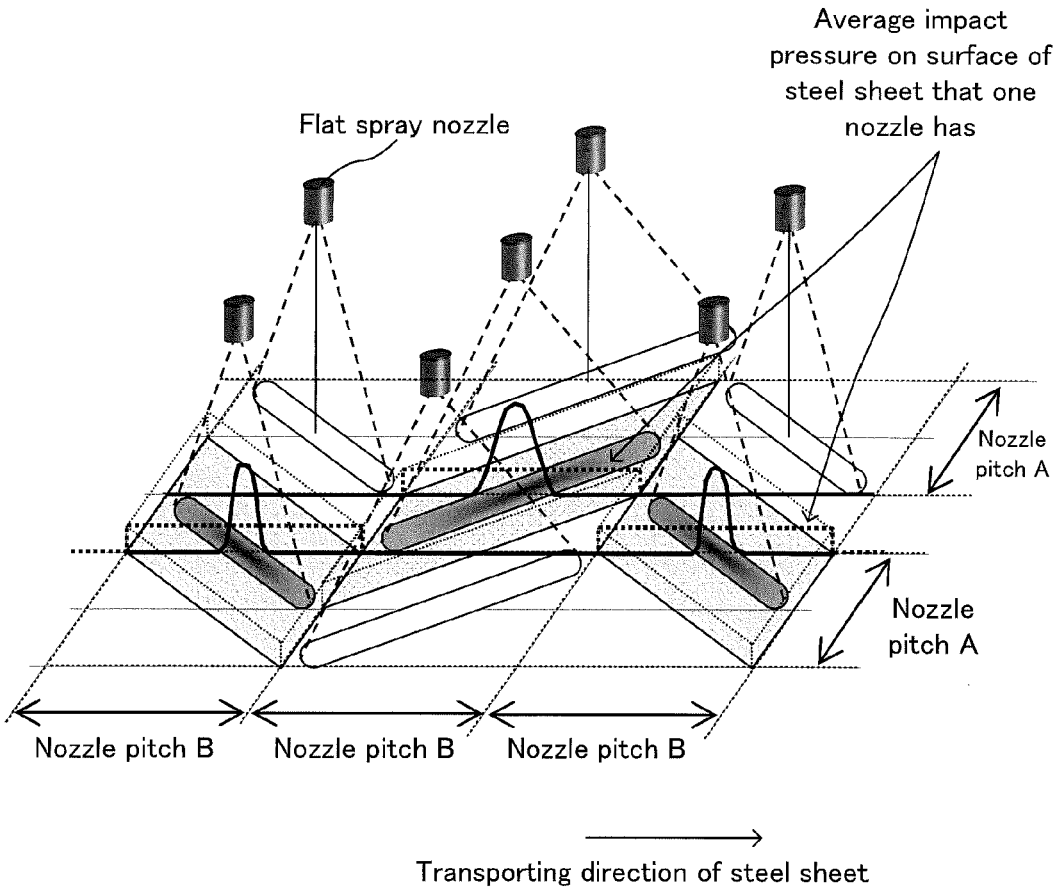
FIG. 6 is a view illustrating the average value per nozzle, of the impact pressure of high-pressure water on the surface of the steel sheet.

FIG. 5 is a view showing a relationship between the average value, in the transporting direction of the steel sheet, of the impact pressure of high-pressure water on the surface of the steel sheet, and an average cooling rate of the steel sheet. A vertical axis in FIG. 5 represents the average cooling rate [° C./s] at a time of cooling, from 750° C. to 600° C., from both sides (upper surface and lower surface) of the steel sheet with a thickness of 3 mm, which has no retained cooling water on the surface thereof. A horizontal axis in FIG. 5 represents the average value [kPa], in the transporting direction of the steel sheet, of the impact pressure of high-pressure water on the surface of the steel sheet. As shown in FIG. 5, there is a correlation between the average value, in the transporting direction of the steel sheet, of the impact pressure of high-pressure water on the surface of the steel sheet, and the average cooling rate of the steel sheet: as the average value, in the transporting direction of the steel sheet, of the impact pressure of high-pressure water on the surface of the steel sheet is increased, the average cooling rate of the steel sheet can be increased. Further, as shown in FIG. 6, the average value, in the transporting direction of the steel sheet, of the impact pressure of high-pressure water on the surface of the steel sheet is determined by averaging the average impact pressure per nozzle of the zones in the transporting direction, wherein the average impact pressure per nozzle is derived by dividing the force (i.e. impact force) of the cooling water striking against a quadrilateral region whose area is represented by A×B, by the quadrilateral region A×B, when defining the nozzle pitch in the width direction of the steel sheet as A; and defining the nozzle pitch in the transporting direction of the steel sheet as B.

In the present invention, from the viewpoint, for example, of enabling rapid cooling of the steel sheet 1 while inhibiting recovery of austenite gains or the like, the average value, in the transporting direction of the steel sheet, of the impact pressure on the surface of the steel sheet, of the high-pressure water sprayed over the steel sheet 1 from the cooling apparatus 20 is configured as follows. That is, when defining L1, a length in the transporting direction of the steel sheet, of the zone from the rolling reduction point in the final stand 11*g* to the exit side of the housing post in the final stand 11*g*; defining as L2, a length in the transporting direction of the steel sheet, of the zone of a high-pressure water jet, in which the high-pressure water is continuously sprayed over the steel sheet, within the zone from the rolling reduction point in the final stand 11*g* to the exit side of the housing post in the final stand 11*g* as L2; and defining the ratio of L2/L1 as X, the average value Ps [kPa], in the transporting direction of the steel sheet, of the impact pressure of the high-pressure water on the surface of the steel sheet in the zone of the high-pressure water jet satisfies a below formula (1) on the upper surface and the lower surface of the steel sheet 1:

$$Ps \geqq 2.5X^{(-1/0.6)} \quad (1)$$

Further, from the same viewpoint, the average value, in the transporting direction of the steel sheet, of the impact pressure on the surface of the steel sheet, of the high-pressure water sprayed from the cooling apparatus 20 over the steel sheet 1 is preferably 3.5 kPa or more. Further, in the present invention, in order to, for example, render crystal grains finer, it is preferable to cool the steel sheet 1 at an average cooling rate of 1000° C./s or more. In view of enabling rapid cooling of the steel sheet 1 at the average cooling rate of 1000° C./s or more, the average value of the impact pressure of cooling water is preferably 8 kPa or more. The cooling rate varies depending on the sheet thickness, and is almost inversely proportional to the sheet thickness. If the cooling apparatus of a hot-rolled steel sheet of the present invention has a capability to cool a steel sheet with a thickness of 3 mm at the average cooling rate of 1000° C./s, it is possible to cool a steel sheet with a thickness of 5 mm at the average cooling rate of 600° C./s.

As described above, the average impact pressure per nozzle is equal to the value which is obtained by dividing the impact pressure of the high-pressure water jetted from the nozzle by the cooling area that the nozzle has. Therefore, even by measuring the impact force instead of measuring the pressure, the average value of the impact pressure of the cooling water can be calculated. Further, the impact force of the high-pressure water can be determined by a flow volume and a flow rate thereof. And the flow volume and the flow rate depend on the pressure of water supply to the nozzle; therefore, if a predetermined pressure loss is predicted, it is possible to roughly estimate the average value of the impact pressure on the surface of the steel sheet, from the pressure of water supply to the nozzle. One example of the calculation method of the average value of the impact pressure on the surface of the steel sheet will be described below:

An average value of an impact pressure on a surface of a steel sheet $Ps=F/(A\cdot B)$ [Pa]

Here, A represents the nozzle pitch [m] in the width direction of the steel sheet. B represents the nozzle pitch [m] in the transporting direction of the steel sheet. F represents the impact pressure [N] of high-pressure water on the surface of the steel sheet. The impact pressure F can be determined by the below formula:

An impact pressure $F=44.7\cdot C\cdot q\cdot P^{0.5}$ [N]

Here, the value 44.7 is a constant [$N^{0.5}$ $S/m^2$] including a value which is the $0.5^{th}$ power of the water density. C represents a coefficient of loss (approximately 0.8 to 1.0). q represents the flow volume [$m^3/s$] of the flat spray nozzle. P represents the water supplying pressure [Pa]. The flow volume of the flat spray nozzle is determined in relation to the water supplying pressure depending on a type (characteristics) of a nozzle.

Further, in the present invention, when there exists retained water on the surface of the steel sheet, the pressure of the high-pressure water sprayed from the nozzle 21*a* is decreased by the retained water, and the impact pressure of the high-pressure water at a time when the high-pressure water reaches the surface of the steel sheet 1 is likely to be decreased. Therefore, to rapidly cool the steel sheet 1, the retained water on the surface of the steel sheet 1 is preferably reduced. In this viewpoint, in the present invention, a space for the cooling water to be discharged is preferably secured between both end surfaces of the cooling apparatus 20 in the width direction of the steel sheet and both end surfaces of the final stand 11*g* in the width direction of the steel sheet In the above descriptions regarding the cooling apparatus 20 of the present invention, a configuration in which the cooling apparatus is provided with the flat spray nozzles 21*a*, 21*a*, . . . , 22*a*, 22*a*, . . . has been shown as one mode, but a configuration of the cooling apparatus of a hot-rolled steel sheet in the present invention is not limited thereto. However, in view of providing a cooling apparatus configured to reduce clogging of the nozzles and to increase the average value, in the transporting direction of the steel sheet, of the impact pressure of the high-pressure water on the surface of the steel sheet even at a time when there exists retained water on the surface, the flat spray nozzles are preferably provided to the cooling apparatus. Further, employing effective arrangements of the flat spray nozzles enables the flat spray nozzles to give directionality to discharge of cooling water existing on the surface of the steel sheet, which results in improvement of a water discharging ability.

Further, in the above descriptions regarding the cooling apparatus 20 of the present invention, the flat spray nozzles 21*a*, 21*a*, . . . , 22*a*, 22*a*, . . . are disposed not only in the zone until the exit side of the housing post in the final stand 11*g* of the row 11 of hot-rolling mills, but also in the region on the downstream side of the zone, to which the present invention is not limited. However, there could be a case in which it is required to rapidly cool the steel sheet to a temperature lower than 720° C. within a short period of time after completion of rolling; accordingly, in view of, for example, providing a cooling apparatus which can keep performing rapid cooling of the steel sheet until the temperature becomes lower than 720° C., it is preferable that the flat spray nozzles be continuously disposed in the zone until the exit side of the housing post in the final stand of the row 11 of hot-rolling mills, and also in the region on the downstream side of the zone.

Still further, in the above descriptions regarding the cooling apparatus 20 of the present invention, the header 21 disposed on the upper surface side of the steel sheet 1 is unified with the upper surface guide 23; and the header 22 disposed on the lower surface side of the steel sheet 1 is unified with the lower surface guide 24; however, the cooling apparatus of a hot-rolled steel sheet of the present invention is not limited to this configuration. The cooling apparatus of a hot-rolled steel sheet of the present invention may be configured in such a manner that the header disposed on the lower surface side of the steel sheet is not unified with the lower surface guide, or that the header disposed on the upper surface side of the steel sheet is not unified with the upper surface guide. To be able to replace the rolls provided to the final stand in the row of hot-rolling mills, the header 21 disposed closely to the work roll 11*gwu*; the upper surface guide 23; the header 22 disposed closely to the work roll 11*gwd*; and the lower surface guide 24 need to be movable; and these may be moved by using a known means such as a hydraulic cylinder. However, in view of, for example, improving the efficiency of replacement of the rolls, it is preferable that the header disposed on the upper surface side of the steel sheet, and the upper surface guide be moved away or returned back simultaneously; thus the header and the upper surface guide are preferably unified. Likewise, it is preferable to unify the header disposed on the lower surface side of the steel sheet with the lower surface guide.

Figure 7:
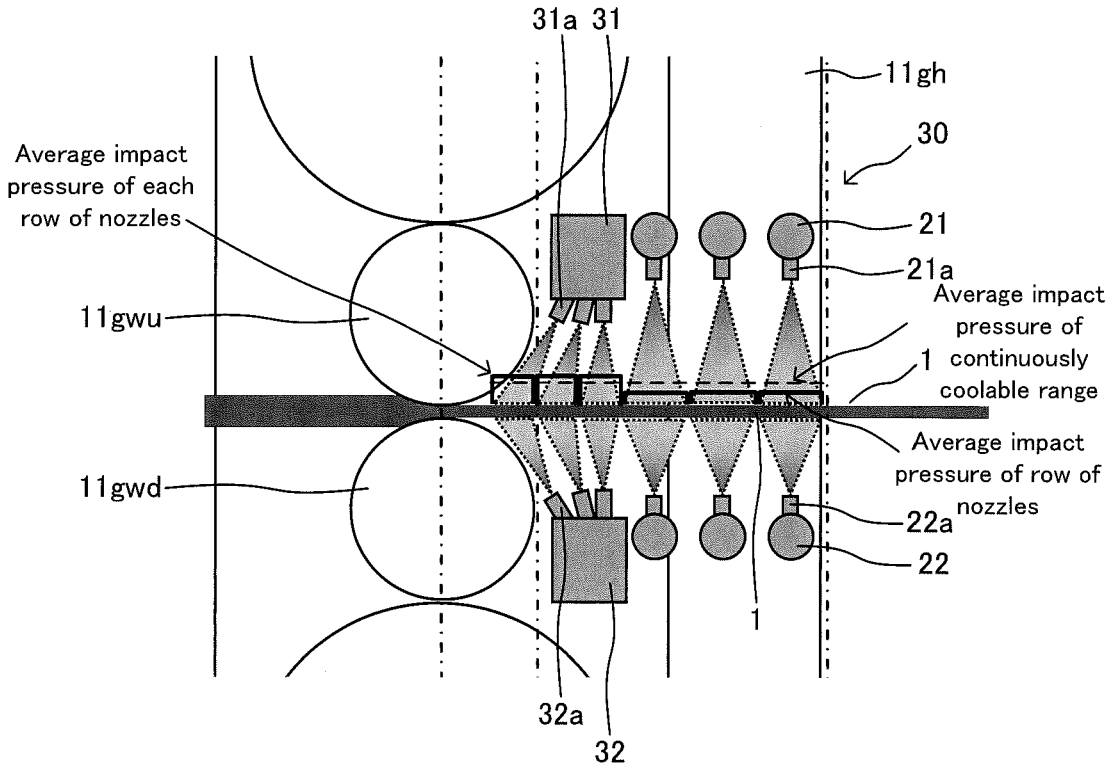
FIG. 7 is a conceptual view of a position corresponding to the radius of a work roll in a final stand, and an exit side of a housing post in the final stand, together with an average value, in a transporting direction of a steel sheet, of an impact pressure of high-pressure water on a surface of the steel sheet, according to another embodiment of the cooling apparatus of the present invention.

Furthermore, in the above descriptions regarding the cooling apparatus 20 of the present invention, only a configuration has been shown in which a plurality of the headers 21, 21, . . . attached with a plurality of the nozzles 21*a*, 21*a*, . . . which are disposed in the width direction of the steel sheet 1 at a predetermined pitch, are disposed in the transporting direction of the steel sheet 1 at a predetermined pitch; and a plurality of the headers 22, 22, . . . attached with a plurality of the nozzles 22*a*, 22*a*, . . . which are disposed in the width direction of the steel sheet 1 at a predetermined pitch, are disposed in the transporting direction of the steel sheet 1 at a predetermined pitch; however, the cooling apparatus of a hot-rolled steel sheet of the present invention is not limited to this configuration. The cooling apparatus of the present invention may be configured in a manner that the header (, which may be referred to as a "set-type header", hereinafter) which is capable of supplying cooling water all at once to the plurality of the nozzles disposed respectively in the width direction and the transporting direction of the steel sheet at a predetermined pitch, is arranged on the upper surface side and/or the lower surface side of the steel sheet. FIG. 7 shows an embodiment of the cooling apparatus of a hot-rolled steel sheet of the present invention provided with a set-type header. FIG. 7 illustrates the cooling apparatus of a hot-rolled steel sheet provided with the set-type header, and also conceptually shows the position corresponding to the radius of the work roll in the final stand and the exit side of the housing post of the final stand, together with the average value, in the transporting direction of the steel sheet, of the impact pressure of the high-pressure water on the surface of the steel sheet. In FIG. 7, to the members configured in the same manner as those of the manufacturing apparatus 10 or the cooling apparatus 20, the same symbols used in FIG. 4 are given and the descriptions are adequately omitted.

As shown in FIG. 7, a cooling apparatus 30 of a hot-rolled steel sheet of the present invention (, which may be simply referred to as a "cooling apparatus 30", hereinafter) is configured in the same manner as the cooling apparatus 20, except that a set-type header 31 capable of supplying cooling water all at once to each flat spray nozzle 31*a*, 31*a*, . . . (, which may be simply referred to as a "nozzle 31*a*" etc., hereinafter) which forms three rows of flat spray nozzles on the most upstream side in the transporting direction of the steel sheet, is provided on the upper surface side of the steel sheet 1; and except that a set-type header 32 capable of supplying cooling water all at once to each flat spray nozzle 32*a*, 32*a*, . . . (, which may be simply referred to as a "nozzle 32*a*" etc., hereinafter) which forms three rows of flat spray nozzles on the most upstream side in the transporting direction of the steel sheet, is provided on the lower surface side of the steel sheet 1 as well. The two rows of the nozzles 31*a*, 31*a*, from the most upstream side in the transporting direction of the steel sheet 1 are connected to the set-type header 31 in a manner capable of obliquely spraying high-pressure water toward the upstream side in the transporting direction of the steel sheet 1; and the two rows of the nozzles 32*a*, 32*a*, from the most upstream side in the transporting direction of the steel sheet 1 are connected to the set-type header 32 in a manner capable of obliquely spraying high-pressure water toward the upstream side in the transporting direction of the steel sheet 1. In the cooling apparatus 30, an inclined angle to a vertical surface of the nozzles 31*a*, 32*a* disposed on the most upstream side in the transporting direction of the steel sheet 1 is set to be larger than the inclined angle to a vertical surface given to the nozzles 31*a*, 32*a* which are adjacent to the nozzles 31*a*, 32*a* disposed on the most upstream side, and are adjacent to the downstream side in the transporting direction of the steel sheet 1. Further, the high-pressure water sprayed from the nozzles 31*a*, 32*a* which are disposed on the most upstream side in the transporting direction of the steel sheet 1 reaches the region closer to the rolling reduction side than to the position corresponding to the radius of the work roll in the final stand. Thus, the cooling apparatus 30 in this configuration, like the cooling apparatus 20, is also capable of manufacturing an ultra fine grain steel.

In this way, by using the cooling apparatuses 20, 30 of the present invention, it is possible to manufacture an ultra fine grain steel. Accordingly, by using the manufacturing apparatus 10 comprising the cooling apparatus 20 or a manufacturing apparatus of a hot-rolled steel sheet comprising the cooling apparatus 30, it is possible to manufacture an ultra fine grain steel. In addition, with a configuration in which to comprise a process to treat a steel sheet rolled in the final stand of the row of hot finish rolling mills by using the manufacturing apparatus of a hot-rolled steel sheet provided with the cooling apparatus 30, or the manufacturing apparatus 10, it is possible to provide a manufacturing method of a hot-rolled steel sheet capable of manufacturing an ultra fine grain steel.

In the present invention, the distance between the nozzles disposed on the upper surface side of the steel sheet and the upper surface of the steel sheet is not particularly limited; however, by arranging the nozzles close to the surface of the steel sheet, it becomes easy to increase the average value of the impact pressure of the cooling water. Accordingly, in view of easily increasing the average value of the impact pressure of the cooling water, the distance between the surface of the nozzle facing the steel sheet (ejection face of the high-pressure water) and the surface of the steel sheet is preferably less than 500 mm; more preferably 350 mm or less.

Further, in the above description, a configuration in which an inclined angle to a vertical surface is given to the nozzles disposed on the upstream side in the transporting direction of the steel sheet has been shown, to which configuration the present invention is not limited. However, by giving an inclined angle to one or more rows of nozzles including the row of nozzles disposed on the upstream side in the transporting direction of the steel sheet, or disposed especially at a position closest to the work roll in the final stand, it becomes easy to make high-pressure water strike against the upper surface and the lower surface of the steel sheet which is at a position nearest to the roll bite within the distance corresponding to the radius of the work roll in the final stand; and thereby, it becomes easy to rapidly cool the steel sheet after rolling. Accordingly, in view of, for example, easily performing rapid cooling of the steel sheet, an inclined angle to a vertical surface is preferably given to one or more rows of nozzles (i.e. the rows of nozzles which are disposed respectively on the upper surface side and the lower surface side of the steel sheet) including the row of nozzles which is disposed at a position closest to the work roll in the final stand (i.e. on the most upstream side in the transporting direction of the steel sheet). And the closer the nozzles are to the upstream side in the transporting direction of the steel sheet, the larger inclined angle to a vertical surface the nozzles are preferably given. Further, to easily perform rapid cooling of the steel sheet, it is preferable that the row of nozzles disposed on the most upstream side in the transporting direction of the steel sheet be given an inclined angle to a vertical surface, and that the distance between the surface of the steel sheet and the surface of the row of nozzles disposed on the most upstream side in the transporting direction of the steel sheet (ejection face of high-pressure water) be made shortest.

Figure 8:
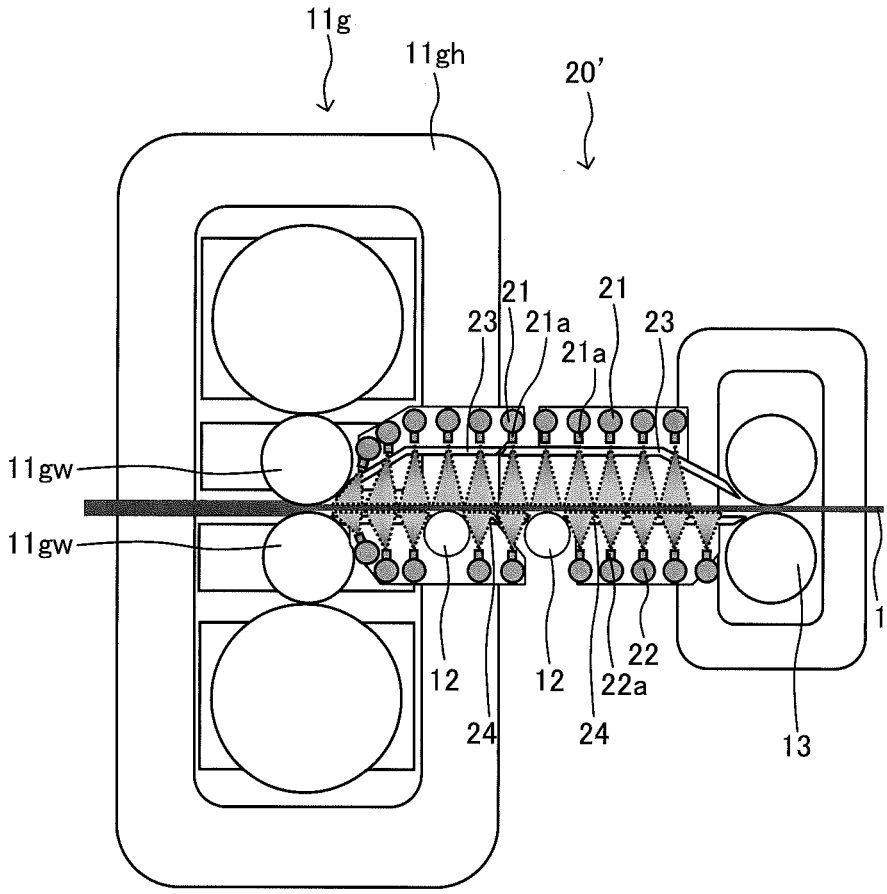
FIG. 8 is an enlarged view of an area in which the cooling apparatus of a hot-rolled steel sheet of the present invention according to another embodiment is disposed.

Still further, the above description has referred to a configuration that a steel sheet is rapidly cooled immediately after the steel sheet passes the rolling reduction point by making high-pressure water continuously strike against the steel sheet at least in the region from within the position corresponding to the radius of the work roll in the final stand of the row of hot finish rolling mills, to the exit side of the housing post in the final stand; however, the present invention is not limited to the configuration. In the present invention, a zone in which high-pressure water is not made to continuously strike against the steel sheet may exist in the within-stand region as long as it is possible to cool the steel sheet to 720° C. or below within 0.2 second after the steel sheet passes the rolling reduction point. If there is an area in the within-stand region in which rapid cooling is difficult (i.e. the zone in which high-pressure water is not made to continuously strike against the steel sheet), the steel sheet may be cooled to 720° C. or below within 0.2 second after the steel sheet passes the rolling reduction point, by increasing the cooling rate in the within-stand region except for the area in which rapid cooling is difficult, and by securing the average cooling rate of 500° C./s in the within-stand region. Examples of the area in the within-stand region in which rapid cooling is difficult include a zone between a position of the roll bite and an upstream end of the range for continuous cooing in the transporting direction of the steel sheet, as shown in FIG. 4. In addition to this, in the same manner as the cooling apparatus 20' of a hot-rolled steel sheet shown in FIG. 8, for example, in a case when a transporting roll 12 is arranged also on the lower surface side of the steel sheet between the rolling reduction point and the exit side of the housing post in the final stand, the area on the lower surface side of the steel sheet which is not struck against by the high-pressure water because of the transporting roll 12 is also the area in which rapid cooling is difficult. With the cooling apparatus 20' as well, it is possible to form ultra fine grains by cooling the steel sheet to 720° C. or below within 0.2 second after the steel sheet passes the rolling reduction point. Accordingly, by using the manufacturing apparatus of a hot-rolled steel sheet comprising the cooling apparatus 20', and by going through the cooling process of the cooling apparatus 20', it is possible to manufacture an ultra fine grain steel. Moreover, with a configuration in which to comprise the process to treat a steel sheet rolled in the final stand of the row of hot finish rolling mills by using the manufacturing apparatus of a hot-rolled steel sheet provided with the cooling apparatus 20', it is possible to provide a manufacturing method of a hot-rolled steel sheet capable of manufacturing an ultra fine grain steel.

Figure 9A:
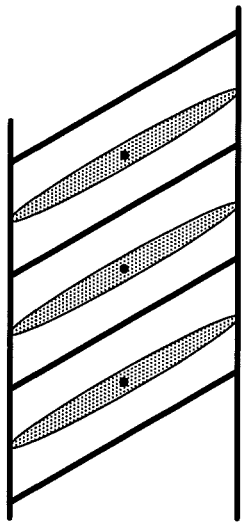
FIG. 9 is a view illustrating an impact shape on a surface of a steel sheet, of high-pressure water sprayed from the nozzles provided to the cooling apparatus of a hot-rolled steel sheet of the present invention.
Figure 9B:
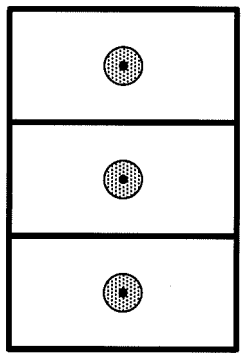
Figure 10:
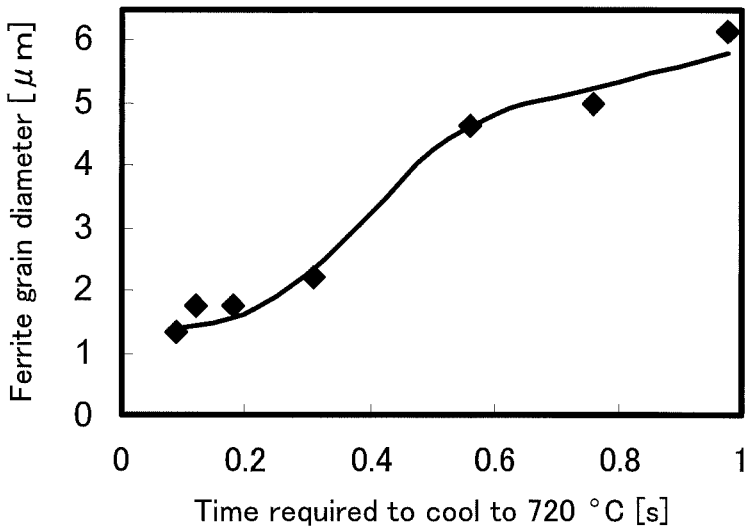
FIG. 10 is a view showing a relationship between the time required to cool to 720° C. and an obtained ferrite grain diameter.

Additionally, the above description has mainly referred to a configuration in which the flat spray nozzle 21*a* and the flat spray nozzle 22*a* are provided to the cooling apparatus of a hot-rolled steel sheet of the present invention, to which the present invention is not limited. The nozzles provided to the cooling apparatus of a hot-rolled steel sheet of the present invention may also be configured in a manner capable of spraying columnar high-pressure water. FIG. 9 shows a shape of an impact on the surface of the steel sheet, of the high-pressure water sprayed from the nozzles provided to the cooling apparatus of a hot-rolled steel sheet of the present invention. In a case when a flat spray nozzle is provided, the shape of the area of the impact on the surface of the steel sheet, of the high-pressure water is, for example, an oval shape, as shown in FIG. 9A. On the other hand, in a case when a spray nozzle capable of spraying the columnar high-pressure water is provided, the shape of the area of the impact on the surface of the steel sheet, of the high-pressure water is, for example, a circular shape, as shown in FIG. 9B.

EXAMPLES

A test was conducted in which: a steel sheet containing 0.1% C by mass and 1% Mn by mass was rolled at an exit side rate of 600 mpm by using a rolling mill with a roll diameter of 700 mm (a roll radius of 350 mm), and with a distance of 1800 mm from the rolling reduction point to the exit side of the housing post, so as to have a sheet thickness of 3 mm on the exit side of the position of the roll bite; and then the steel sheet was rapidly cooled. A research was conducted on the ferrite grain diameters which were finally obtained by setting a temperature of completion of rolling at 820° C., and by varying the average values of the impact pressure of cooling water in the region between the cooling-start point and the exit side of the housing post. When it was not possible to fully cool the steel sheet to 720° C. in the zone until the exit side of the housing post, the steel sheet was cooled by using the cooling apparatus continuing after the exit side of the housing post. The results are shown in Table 2. The conditions Nos. 1 to 4 which satisfied the above formula (1) is an example of the present invention; and the condition No. 5 which did not satisfy the above formula (1) is a comparative example. In Table 2, the average value of the impact pressure of cooling water (the average value, in the transporting direction of the steel sheet, of the impact pressure of high-pressure water on the surface of the steel sheet) is written as an "average impact pressure".

TABLE 2

| No. | Cooling-start position [mm] | Average impact pressure [kPa] | Average cooling rate [° C./s] | Distance to reach 720° C. [mm] | Time required to reach 720° C. [s] | Ferrite grain diameter [μm] | Notes |
|---|---|---|---|---|---|---|---|
| 1 | 100 | 3.5 | 615 | 1720 | 0.172 | 1.7 | Example of present invention |
| 2 | 150 | 3.5 | 615 | 1770 | 0.177 | 1.8 | Example of present invention |
| 3 | 150 | 8.0 | 1010 | 1140 | 0.114 | 1.6 | Example of present invention |
| 4 | 300 | 4.5 | 715 | 1700 | 0.170 | 1.8 | Example of present invention |
| 5 | 1000 | 3.5 | 615 | 2620 | 0.262 | 2.4 | Comparative Example |

As shown in Table 2, in the conditions Nos. 1 to 4 which satisfied the above formula (1), an ultra fine grain microstructure having a ferrite grain diameter of less than 2 μm was obtained by starting cooling a steel sheet from within the position corresponding to the roll radius which is at 350 mm (from the rolling reduction point), and by completing cooling the steel sheet to 720° C. in the zone until the exit side of the housing post which is at 1800 mm (from the rolling reduction point) (in other words, by completing cooling to 720° C. within 0.2 second after rolling). On the other hand, in the condition No. 5, the cooling-start position was far away on the downstream side, from the position corresponding to the roll radius, and the formula (1) was not satisfied; thus the ferrite grain diameter was above 2 μm.

Further, a transporting roll was disposed between the rolling reduction point and the exit side of the housing post in the same rolling mill as the one used in the above examples; and the same rolling test as above was also conducted even after it became difficult to perform rapid cooling before and after the transporting roll. At this time, assuming a case in which a part of the cooling headers should become unusable for the purpose of securing a sheet passing stability or due to such circumstances as a breakdown of equipment, a condition was also added in which a part of the middle-positioned cooling headers (i.e. the cooling headers excluding the cooling header on the most upstream end and the header on the most downstream end among the cooling headers supplied with cooling water which cools the steel sheet existing in the within-stand region) was deliberately not used. The rapid-cooling start point was uniformly set at 150 mm away on the downstream side from the rolling reduction point. As previously stated, the common distance from the rolling reduction point in the final stand of a row of hot finish rolling mills to the exit side of the housing post of the final stand is approximately 2 m (approximately 2000 mm). Here, the length L1 of the within-stand region from the rolling reduction point in the final stand to the exit side of the housing post of the final stand was set to be 1800 mm. If it should be possible to realize a rolling mill in which the length in the within-stand region from the rolling reduction point to the exit side of the housing post of the final stand is made even shorter, the steel sheet may be further cooled on the exit side of the housing post which is left with some space to a degree to which the length was shortened. Further, the length L3 of an area in which rapid cooling cannot be performed is a total length including the length of 150 mm from the rolling reduction point to the rapid-cooling start point as well as the length of the region in which rapid cooling is impossible, such as before and after the transporting roll. The length L2 of the rapidly coolable range is a value obtained by subtracting L3 from L1. In a case when the area in which rapid cooling is impossible is only on one surface, such as the area in which the transporting roll is disposed, and cooling can be carried out on the opposite surface, the length of the region in which rapid cooling is impossible was determined by halving the length of the area in which rapid cooling is impossible.

The results are shown in Table 3. In Table 3, the average value of the impact pressure of cooling water (the average value, in the transporting direction of the steel sheet, of the impact pressure of high-pressure water on the surface of the steel sheet) is written as an "average impact pressure". Further, X in Table 3 represents the ratio of L2/L1.

TABLE 3

| No. | Length of non-rapid cooling L3 [mm] | Length of rapid cooling L2 [mm] | X | Average impact pressure [kPa] $2.5X^{(-1/0.6)}$ | Average impact pressure [kPa] Actual values | Cooling rate [° C./s] Rapid cooling area | Cooling rate [° C./s] Average within stand | Ferrite grain diameter [μm] | Notes |
|---|---|---|---|---|---|---|---|---|---|
| 6 | 300 | 1500 | 0.83 | 3.39 | 3.5 | 613 | 511 | 1.9 | Example of present invention |
| 7 | 450 | 1350 | 0.75 | 4.04 | 3.5 | 613 | 460 | 2.2 | Comparative Example |
| 8 | 450 | 1350 | 0.75 | 4.04 | 5.0 | 760 | 570 | 1.8 | Example of present invention |
| 9 | 750 | 1050 | 0.58 | 6.14 | 5.0 | 760 | 443 | 2.3 | Comparative Example |

TABLE 3-continued

| No. | Length of non-rapid cooling L3 [mm] | Length of rapid cooling L2 [mm] | X | Average impact pressure [kPa] $2.5X^{(-1/0.6)}$ | Actual values | Cooling rate [° C./s] Rapid cooling area | Average within stand | Ferrite grain diameter [μm] | Notes |
|---|---|---|---|---|---|---|---|---|---|
| 10 | 750 | 1050 | 0.58 | 6.14 | 9.0 | 1081 | 631 | 1.7 | Example of present invention |
| 11 | 1050 | 750 | 0.42 | 10.76 | 9.0 | 1081 | 450 | 2.3 | Comparative Example |
| 12 | 1050 | 750 | 0.42 | 10.76 | 17.0 | 1583 | 660 | 1.5 | Example of present invention |

As shown by the conditions Nos. 6, 8, 10, and 12 in Table 3, even when there is a region in the within-stand region in which rapid cooling is impossible, it was possible to obtain the average cooling rate of 500° C./s or more in the within-stand region, by having the average impact pressure of high-pressure water in the cooling region of the length L2 within the range determined by the above formula (1). And under all of these conditions, an ultra fine grain microstructure with a ferrite grain diameter of less than 2 μm was obtained. However, under the condition No. 12, the average impact pressure reached 17 kPa, and it is costly, in building and operating a line, and thus unrealistic to achieve the average impact pressure higher than this value. Therefore, it is desirable to secure the rapid cooling length L2 of at least 750 mm or more. Besides, this rapid cooling length L2 of at least 750 mm or more doe not require a continuous region having 750 mm or more; it is good enough if a total length of the rapid cooling regions amounts to 750 mm or more. On the other hand, as under the conditions Nos. 7, 9, and 11, in a case when the average impact pressure of the high-pressure water in the rapid cooling region is outside the range determined by the above formula (1), the average cooling rate in the within-stand region was below 500° C./s, and the ferrite grain diameter was above 2 μm.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a cooling apparatus of a hot-rolled steel sheet, a cooling method of a hot-rolled steel sheet, a manufacturing apparatus of a hot-rolled steel sheet, and a manufacturing method of a hot-rolled steel sheet with such modifications are also encompassed within the technical range of the invention.

Industrial Applicability

The cooling apparatus of a hot-rolled steel sheet, the cooling method of a hot-rolled steel sheet, the manufacturing apparatus of a hot-rolled steel sheet, and the manufacturing method of a hot-rolled steel sheet can be used for manufacturing a hot-rolled steel sheet having ultra fine crystal grains. Further, the hot-rolled steel sheet having ultra fine crystal grains can be used as a raw material, for example, in manufacturing automobiles, household electric appliances, and machine structures, and in constructing buildings.

The invention claimed is:

1. A manufacturing apparatus of a hot-rolled steel sheet comprising a final stand of a row of hot finish rolling mills and a cooling apparatus the cooling apparatus disposed on a downstream side of a rolling reduction point in a final stand of a row of hot finish rolling mills, and which comprises headers provided with a plurality of cooling nozzles capable of spraying high-pressure water over an upper surface and a lower surface of a steel sheet being transported on a pass line, wherein the cooling apparatus is configured in a manner capable of spraying the high-pressure water from the cooling nozzles, in a transporting direction of the steel sheet, over the upper surface and the lower surface of the steel sheet in a zone from the rolling reduction point in the final stand to an exit side of a housing post in the final stand; and the cooling apparatus is configured in a manner capable of continuously spraying the high-pressure water in the transporting direction of the steel sheet, at least in a zone extending to the exit side of the housing post in the final stand, from a position between the rolling reduction point, at which the steel sheet and the work rolls in the final stand contact with each other, and the position away from said rolling reduction point toward the downstream side in the transporting direction of the steel sheet in the amount of the radius of the work roll in the final stand.

2. The manufacturing apparatus of a hot-rolled steel sheet according to claim 1, wherein among the headers disposed at least between the rolling reduction point in the final stand and the exit side of the housing post in the final stand, the header arranged closely to the work roll in the final stand is configured to be movable to the position where the replacement of the work roll in the final stand is possible.

3. The manufacturing apparatus of a hot-rolled steel sheet according to claim 1, wherein the cooling apparatus is sized to spray water on the upper and lower surface of the steel sheet such that an average value, in the transporting direction of the steel sheet, of impact pressure of the high-pressure water on the surface of the steel sheet in said zone, is 3.5 kPa or more on the upper surface and the lower surface.

4. The manufacturing apparatus of a hot-rolled steel sheet according to claim 1, wherein a rapidly cooled region having a length of over 0.75 m in the transporting direction of the steel sheet exists in the zone of a high-pressure water jet on both upper surface side and lower surface side of the steel sheet.

5. The manufacturing apparatus of a hot-rolled steel sheet according to claim 1, wherein the nozzles are flat spray nozzles.

6. The manufacturing apparatus of a hot-rolled steel sheet according to claim 1, wherein a space for discharging cooling water is secured between both end surfaces of the cooling apparatus in the width direction of the steel sheet and both end surfaces of the final stand in the width direction of the steel sheet.

7. The manufacturing apparatus of a hot-rolled steel sheet according to claim 1, wherein the header and the nozzles arranged on the upper surface side of the steel sheet are unified with an upper surface guide arranged between the nozzles and the pass line.

8. The manufacturing apparatus of a hot-rolled steel sheet according to claim 1, wherein the header and the nozzles arranged on the lower surface side of the steel sheet are unified with a lower surface guide arranged between the nozzles and the pass line.

9. The manufacturing apparatus of a hot-rolled steel sheet according to claim 1, wherein a plurality of the headers are provided; and at least a part of the headers is configured in a manner capable of supplying cooling water all at once, to the nozzles which are arranged, in a form of a plurality of rows, respectively in the transporting direction and in the width direction of the steel sheet.

10. The manufacturing apparatus of a hot-rolled steel sheet according to claim 9, wherein a plurality of the headers are disposed on the upper surface side of the steel sheet; and among the headers arranged on the upper surface side of the steel sheet, at least the header which is disposed on the most upstream side in the transporting direction of the steel sheet, is configured in a manner capable of supplying cooling water all at once, to the nozzles which are arranged, in a form of a plurality of rows, respectively in the transporting direction and in the width direction of the steel sheet.

11. The manufacturing apparatus of a hot-rolled steel sheet according to claim 9, wherein a plurality of the headers are disposed on the lower surface side of the steel sheet; and among the headers disposed on the lower surface side of the steel sheet, at least the header which is disposed on the most upstream side in the transporting direction of the steel sheet is configured in a manner capable of supplying cooling water all at once, to the nozzles which are arranged, in a form of a plurality of rows, respectively in the transporting direction and in the width direction of the steel sheet.

12. A manufacturing method of a hot-rolled steel sheet comprising a process to treat the steel sheet rolled in the final stand of the row of hot finish rolling mills by using the manufacturing apparatus of a hot-rolled steel sheet according to claim 1.

* * * * *